United States Patent [19]

Bildstein et al.

[11] 4,029,828

[45] June 14, 1977

[54] X-RAY TARGET

[75] Inventors: Hubert Bildstein; Rudolf Machenschalk; Helmut Petter, all of Tyrol, Austria

[73] Assignee: Schwarzkopf Development Corporation, New York, N.Y.

[22] Filed: June 16, 1976

[21] Appl. No.: 696,489

[30] Foreign Application Priority Data

June 23, 1975 Austria ..... 4809/75

[52] U.S. Cl. ..... 427/34; 427/423; 313/330

[51] Int. Cl.[2] ..... B05D 3/06

[58] Field of Search ..... 313/330; 427/34, 423

[56] References Cited

UNITED STATES PATENTS

| | | | |
|---|---|---|---|
| 3,649,355 | 3/1972 | Hennig | 427/34 |
| 3,751,295 | 8/1973 | Blumenthal et al. | 427/34 |
| 3,753,666 | 8/1973 | Carroll | 427/34 |
| 3,919,124 | 11/1975 | Friedel et al. | 313/330 |
| 3,982,148 | 9/1976 | Kaplan | 313/330 |
| 3,993,923 | 11/1976 | Magendans et al. | 313/330 |

*Primary Examiner*—John H. Newsome

*Attorney, Agent, or Firm*—Morgan, Finnegan, Pine, Foley & Lee

[57] ABSTRACT

A target for an X-ray tube is coated outside of the area impinged on by electrons with a layer of thermally emissive material comprising 6–20% by weight $TiO_2$ and 80–94% $Al_2O_3$. The coating is applied for example by plasma flame spraying.

10 Claims, No Drawings

X-RAY TARGET

The present invention relates to an X-ray target, particularly a rotating target, made of a refractory metal, which is coated outside the focal area with a layer of ceramic oxide material in order to increase the thermal emission of the target.

As is generally known, only about 1% of the primary electrical energy is converted into X-ray energy; the remainer is transformed into heat and this must be removed from the target mainly by radiation. The upper limit of the X-ray output or the maximum continuous operating time of a target of refractory metals with good thermal conductivity is determined by the thermal emission of the target surface. Hence, several attempts have been made in the past to increase the thermal emission of the target surface by coating with suitable materials.

Carbon black, graphite, tantalum and tungsten, hard materials such as tantalum and hafnium carbide, oxide-ceramic materials and metal-oxide ceramic compound materials have been proposed as coating materials. The diverse nature of these materials suggests that the coating process involves problems of adhesion, thermal conductivity and material evaporation. A completely satisfactory solution has not yet been found.

Interest currently centers on coating of rotary targets with ceramic oxides by the plasma spray method. Mixtures of powdered $Al_2O_3$ and $TiO_2$, commercially available in a large number of mixture ratios and particle size distributions, are the preferred starting material. These powders are sprayed in the molten condition on the underside of the targets. This is followed by approximately 1½ hours annealing at about 1600° C in a protective atmosphere or high vacuum.

German "Offenlegungsschrift" No; 2,201,979 claims coating materials containing $TiO_2$ with addition of at least one other refractory oxide, particularly 50 weight-% $Al_2O_3$. The good adhesion, stability and ductility as well as the intense blackness of this coating material are emphasized.

More recently, a composition of 94–98 weight -% alumina and 2–6 weight-% $TiO_2$ was described as particularly suitable. This coating material is also claimed to possess good adhesion and thermal conductivity as well as a high density of over 90% of theoretical, thus a low gas content.

However, practical experience has not confirmed these claims for the above-described compositions. In fact, it has revealed certain deficiencies. In the first case of high titania content, an eutectic phase with a melting point of about 1860° C is formed in the coating. As the targets are usually made of molybdenum, tungsten or their alloys, and thus have a melting point considerably above 1860° C, such a coating greatly limits the permissible operating temperature of the target. Similarly, the coatings with 94–98 weight-% alumina and 2–6 weight-% $TiO_2$ did not fulfill expectations. The titania addition is insufficient to counteract the brittleness of the alumina. Since the target usually has a quite different thermal expansion coefficient, the resistance of the coating to cyclic temperature variations is inadequate. If the thickness of a sufficiently rough coating is kept below 40 microns, there is a risk of uneven thickness and, consequently, there is the disadvantage, compared with the high-titania compositions, of a low degree of blackness and thus low thermal emission.

Thus, within certain mixing ranges of the $Al_2O_3$-$TiO_2$ powder, different material properties alternatingly play a role and bear greatly on the relative usefulness of the material for coating. This phenomenon was not fully recognized nor appreciated until now.

Accordingly, it was discovered that a target coated with a 20–500 micron thick layer, consisting of a mixture of over 6 to under 20 weight-% $TiO_2$ and over 80 to under 94 weight-% $Al_2O_3$, preferably 10–15 weight-% $TiO_2$ and 85–90 weight-% $Al_2O_3$ provided unexpected and highly desirable properties.

In a preferred embodiment, the base body of a rotating target is made of Mo-5 weight-% W alloy. The focal area is made of tungsten-5 weight-% rhenium. A powder mixture, consisting of 13 weight-% $TiO_2$ and 87 weight-% $Al_2O_3$ with particle sizes between 10 and 80 microns, is applied to the underside of the target in a thickness of approximately 80 microns by plasma spraying. The coated target is then annealed for 1½ hours at 1600° C; the originally light-gray coating then takes on a dark gray color.

In addition to plasma spraying, all known methods of powder and wire spraying are suitable provided that the powder is brought to a temperature above its melting point.

X-ray targets coated with the powder mixture according to this invention substantially fulfull all requirements. In particular, the coating material, due to a sufficiently high proportion of $TiO_2$ in the powder mixture, is sufficiently ductile to permit the application of an optimum coating thickness of 70–120 microns. The resistance to cyclic temperature variations and thus the service life is at least equal to that of coating compositions with over 50 weight-% $TiO_2$ but is free of their disadvantage of forming an eutectic phase melting at 1860° C. The degree of blackening corresponds to that of a coating material containing approximately 50 weight-% $TiO_2$ and is considerably greater than that of a mixture with high alumina content. On a practical basis, the compositions claimed herein exhibit higher X-ray intensities and considerably longer continuous operation as compared with the previously used mixtures. Moreover, these important improvements are not obtained at the expense of the service life of the target.

It should be understood by those skilled in the art that various modifications may be made in the present invention without departing from the spirit and scope thereof as described in the specification and defined in the appended claims.

What is claimed is:

1. An X-ray target made of a refractory metal having a high thermal emission coating outside the focal area, the improvement comprising having the target surface outside the focal area equipped with a coating of a mixture consisting of more than 6 and less than 20 weight-% $TiO_2$ and more than 80 and less than 94 weight-% $Al_2O_3$.

2. The X-ray target according to claim 1 wherein said target is a rotating target.

3. The X-ray target according to claim 1 wherein the thickness of said coating is from 20 to 500 microns.

4. The X-ray target according to claim 1 wherein said coating mixture consists of from 10–15 weight-% $TiO_2$ and from 85 to 90 weight-% $Al_2O_3$ and the thickness of said coating is from 70 to 120 microns.

5. The X-ray target according to claim 4 wherein said coating mixture consists of 13 weight-% $TiO_2$ and 87 weight-% $Al_2O_3$ and the thickness of said coating is about 80 microns.

6. The X-ray target according to claim 1 wherein said coating material is equipped on the underside of the target.

7. A method for producing the X-ray target according to claim 1 which comprises applying the mixture to the refractory metal in the form of a powder by plasma spraying.

8. The method of claim 7 wherein subsequent to application the resulting coating is annealed.

9. The method of claim 7 wherein said powder comprises particles having a particle size in the range from 10 to 80 microns.

10. The method of claim 7 which comprises applying a powdered mixture consisting of 13 weight-% $TiO_2$ and 87 weight-% $Al_2O_3$, said powdered mixture composed of particles having a particle size in the range from 10 to 80 microns, to the underside of the target made of refractory metal by plasma spraying and subsequently annealing the coated target for about 1½ hours at 1600° C.

* * * * *